United States Patent [19]

Claude

[11] Patent Number: 4,805,868

[45] Date of Patent: Feb. 21, 1989

[54] ISOLATION BRACKET ASSEMBLY FOR ENGINE COOLING FAN AND MOTOR

[75] Inventor: George T. Claude, Bellbrook, Ohio

[73] Assignee: General Motors Corporation, Detroit, Mich.

[21] Appl. No.: 115,574

[22] Filed: Oct. 15, 1987

Related U.S. Application Data

[63] Continuation of Ser. No. 890,688, Jul. 25, 1986, abandoned.

[51] Int. Cl.[4] ..... F24H 3/06

[52] U.S. Cl. ..... 248/603; 248/638; 165/122

[58] Field of Search ..... 248/603, 604, 638; 16/2; 165/122

[56] References Cited

U.S. PATENT DOCUMENTS

| | | | |
|---|---|---|---|
| 2,261,955 | 11/1941 | Browne | 248/556 |
| 2,711,871 | 6/1955 | Eck | 248/612 |
| 3,556,445 | 1/1971 | Werner | 248/612 |
| 3,564,676 | 10/1968 | Oeser | 248/74.4 |
| 3,606,218 | 9/1971 | Enlund | 248/74.2 |
| 3,795,274 | 3/1974 | Fieni | 165/122 |
| 3,830,595 | 8/1974 | Carpenter | 248/603 |
| 4,133,508 | 1/1979 | Sloyan | 248/558 |
| 4,161,812 | 7/1979 | Litch | 248/638 |
| 4,513,954 | 4/1985 | Cantamessa | 16/2 X |

*Primary Examiner*—Alvin C. Chin-sue

*Attorney, Agent, or Firm*—Charles R. White

[57] ABSTRACT

Corrugated coring of the inside of an isolator grommet forms radial fingers which engage the outer surface of a metallic spacer which provides an attachment for the arms of a bracket to upper and lower tie bars so that the isolator will provide a high spring rate between a bladed fan and radiator while allowing the fan package to have more freedom in the radial direction while keeping the clearance between the fan and radiator as close as possible while damping the vibratory energy generated by the fan and motor.

2 Claims, 2 Drawing Sheets

ISOLATION BRACKET ASSEMBLY FOR ENGINE COOLING FAN AND MOTOR

This is a continuation of application Ser. No. 890,688, filed on July 25, 1986. Now Abandoned.

This invention relates to engine cooling fan and fan motor mounting brackets and more particularly to a mounting bracket assembly which incorporates dual spring rate grommet assemblies that vibrationally isolate the fan and motor from support structure within the vehicle and allows positioning of the fan closely adjacent to the face of engine coolant radiator for high air pumping efficiency.

Prior to the present invention, mounting bracket assemblies have been used to mount the fan and electric fan drive motors close to the back side of a radiator through which engine coolant fluid is circulated for highly efficient pumping of the cooling air through the radiator. While these prior bracket assemblies performed as intended, vibratory energy from the motor and fan is transmitted by the bracket assembly to support structure in the vehicle. This transmitted vibratory energy is objectionable from a noise standpoint and detracts from the comfort of the driver and passengers in the vehicle. These vibrations also contributed to external noise generated by the vehicle.

This invention provides a new and improved mounting bracket assembly with vibratory energy from the fan and fan drive motor mounted by the assembly dissipated or absorbed by specialized resilient isolator grommets. These grommets are dual rate springs and have a soft or low spring rate in a radial direction so that vibratory energy is readily dissipated by the deflection of the low spring rate portion of the grommets. Furthermore, the grommets have a high spring rate in the longitudinal direction (the direction of vehicle travel) so that the fan can be mounted close to the rear of the engine coolant radiator for high efficiency pumping of air through the radiator. With longitudinally stiff spring rate grommets, the rotating fan will be located for rotation in a fixed plane and will not have excessive run out or wobble. Accordingly, the fan will not strike the rear of the radiator to otherwise damage the radiator or fan.

It is an object, feature and advantage of this invention to provide a new and improved bracket assembly with optimized isolation of the fan and fan drive motor to reduce vibratory noise otherwise generated thereby and to prevent the vibrations from being transmitted into the body of the vehicle. Furthermore, this invention provides a new and improved bracket assembly for mounting the cooling fan as close to the radiator as possible utilizing grommet assemblies as high spring rate mounting so that the fan assembly will pump air with high efficiency and will not wobble and strike the rear of the radiator.

These and other features, objects and advantages of this invention will be more apparent from the following detailed description and drawing in which.

Figure 1:
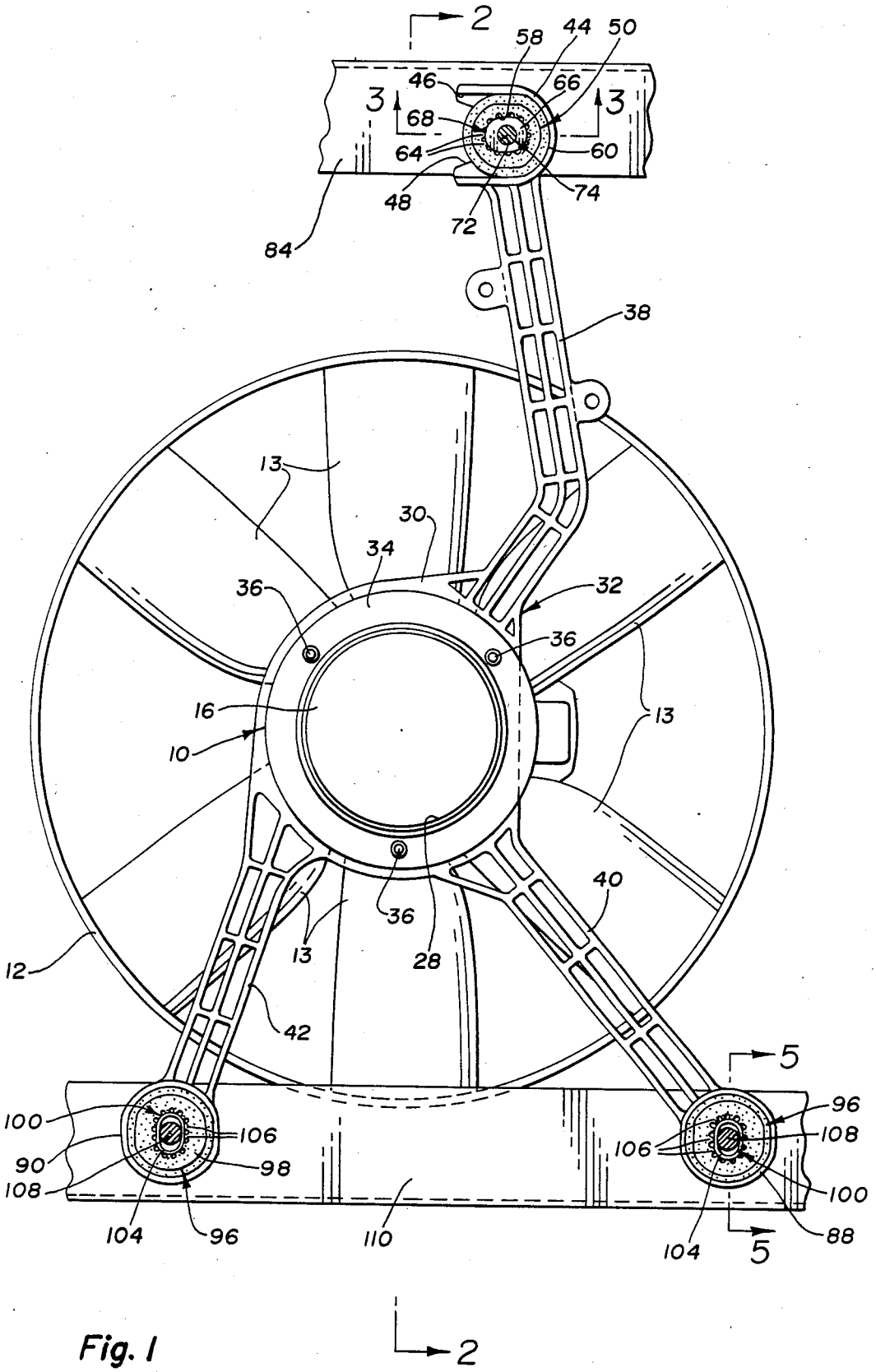
FIG. 1 is a rear elevational view of a bracket assembly mounting an engine cooling fan and motor to upper and lower tie rods or other support structure in a vehicle.
Figure 2:
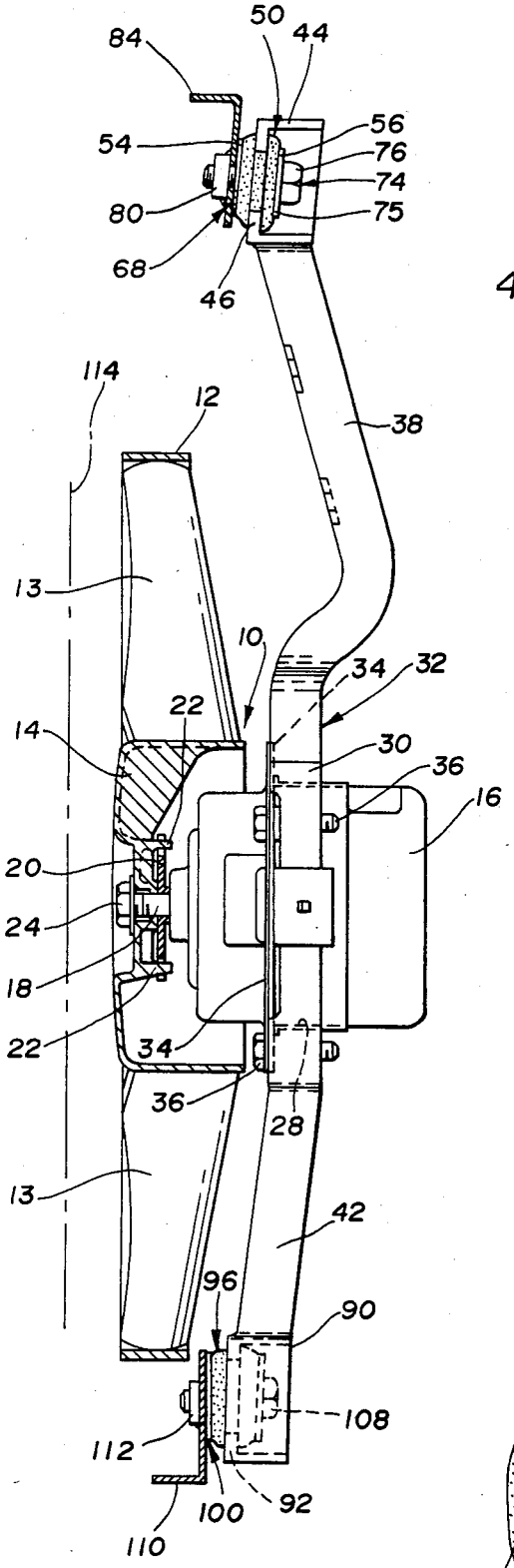
FIG. 2 is a cross-sectional view taken along lines 2—2 of FIG. 1.

Turning now in greater detail to the drawings, FIGS. 1 and 2 show a bladed engine cooling fan assembly 10 having a rotating ring shroud 12 connected by the blades 13 to a centralized hub 14. This fan is driven by an electric motor 16 which has a rotatable output shaft 18 that is drivingly connected to the hub 14 by a rear base plate 20 secured to rearwardly extending projections 22 from the hub and by a forward nut 24 threaded on the end of the shaft 18.

Figure 3:
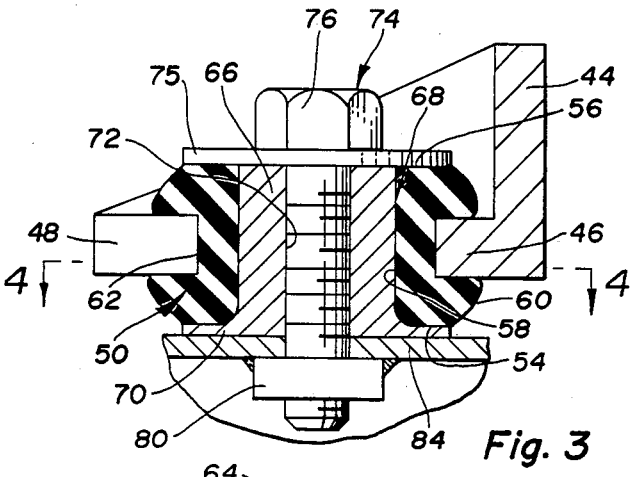
FIG. 3 is a cross-sectional view taken along lines 3—3 of FIG. 1.
Figure 4:
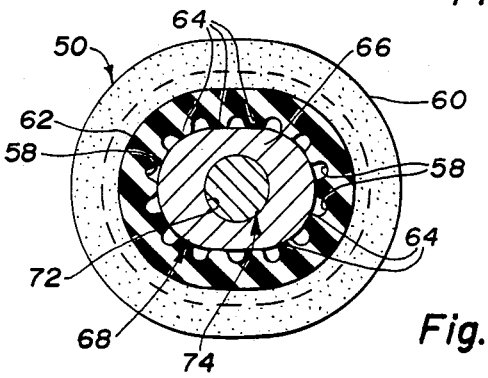
FIG. 4 is a cross-sectional view taken along lines 4—4 of FIG. 3.
Figure 5:
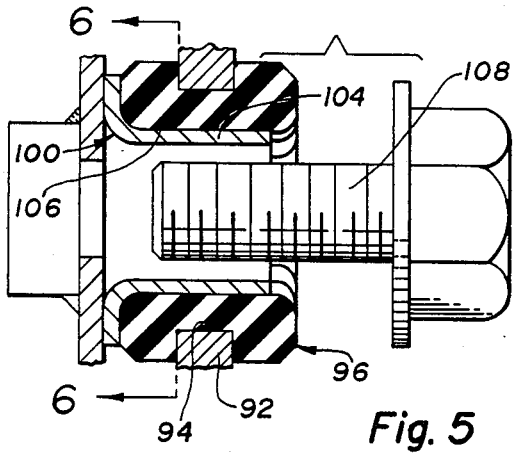
FIG. 5 is a cross-sectional view taken along lines 5—5 of FIG. 1.
Figure 6:
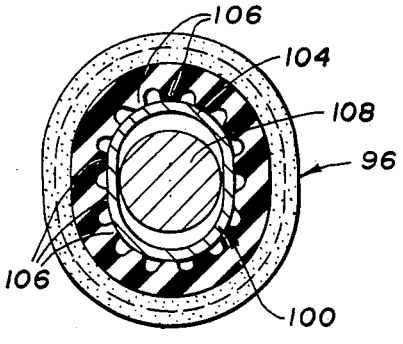
FIG. 6 is a cross-sectional view taken along lines 6—6 of FIG. 5.

The motor 16 is secured within an annular opening 28 in a central portion 30 of a multi-legged bracket assembly 32 by an annular mounting flange 34 and by threaded fasteners 36 which secure the flange to the central portion of the bracket assembly. Extending outwardly from the center portion 30 of the bracket assembly are radial arms 38, 40 and 42. Arm 38 terminates in an attachment end portion 44 having an attachment wall 46 which defines a transversely extending U-shaped slot 48. This slot receives a resilient grommet 50 of Neoprene rubber or other suitable resilient material and is formed as a thick oval or annulus having front and rear walls 54 and 56 and inner and outer diameter surfaces 58 and 60. The outer surface 60 has an inwardly extending oval groove 62 formed therein to closely receive the attachment walls 46 of the attachment end portion 44 of the arm 38. The inner diameter surface 58 is corrugated so that it is formed with a plurality of spaced and inwardly extending resilient fingers 64, the tips of which contact the outer surface of the thick neck portion 66 of a bracket location spacer 68. These fingers provide the radial low spring rate portions of the grommet and deflect to dissipate radial vibratory energy. The spacer has a flat head 70 which seats against the front side wall 54 of the grommet 50. A central opening 72 in the neck portion 66 of this spacer has a diameter to longitudinally guide a threaded fastener 74 therethrough. Fastener 74 has a large diameter flat, washer 75 located beneath the polygonal head 76 thereof. This fastener threads into a nut 80 welded or otherwise fixed within the confines of the upper cross tie 84 as shown in FIGS. 2 and 3. The washer 75 under load by the threaded fastener 74 compressively loads the grommet 50 to provide a high spring rate isolator attachment of arm 38 in a general longitudinal direction. The arms 40 and 42 of the bracket 32 also terminate in attachment end portions 88 and 90 which are substantially identical to each other. Each of the attachment end portions 88 and 90 has a recessed forward wall 92 formed with an oval-shaped opening 94 therein and each receives a grommet 96 identical to the upper grommet 50. Instead of a thick necked locator spacer 68 such as used in the attachment end portion for the upper arm 38, the grommet assemblies for the lower arms 40 and 42 have metallic spacers 100 each with a thin-walled neck oval-shaped in cross section. The outer surface of each neck is engaged by the tips of the low spring rate fingers 106 of the grommet 96 to dissipate radial vibration energy as in the upper grommet assembly. The thin wall lower neck 104 of the lower spacers provides an opening with a large vertical major diameter as shown in FIGS. 1 and 6 that received threaded fasteners 108. This vertical diameter provides clearance for the vertical adjustment of the bracket assembly 32 and accordingly, provides for a wide range of vertical spacing between upper and lower cross ties 84 and 110 that may occur in similar vehicles.

The lower grommets 96 are compressively loaded in the longitudinal direction by threaded fasteners 108 which thread into nuts 112 secured within the lower cross tie 110. The high spring rate attachment provided by the upper and lower grommets locates the fan and maintains its location to keep the fan from striking the rear of the radiator which is diagrammatically illustrated by line 114 that forms the plane of the back side of the radiator. The resilient fingers of all of the grommets dissipate the energy of radial vibration as pointed out above.

In both cases, the grommets for the upper and lower attachment end portions are interchangeable so that only one size grommet is needed for this invention.

While a preferred embodiment of this invention has been illustrated, other embodiments will now become more apparent to those skilled in the art. Accordingly, these embodiments are intended to be covered by the following claims.

The embodiments of the invention in which an exclusive property or privilege is claimed are defined as follows:

1. In combination with a radiator through which engine coolant is circulated, support structure adjacent to said radiator, a bracket assembly for mounting a rotating cooling fan assembly to said support structure and closely adjacent to a face of said radiator for drawing cooling air therethrough, said bracket assembly comprising first and second arm means, each of said arm means having an attachment end portion, each attachment end portion having wall means defining an opening therethrough, first and second grommet means of resilient rubber-like material for each of said openings and secured to the wall means defining said openings, each of said grommets being substantially identical with each having an endless curved body of predetermined thickness as defined by laterally spaced first and second side walls and having inner and outer generally diametrical surfaces, said inner diametrical surface defining an elongated opening and having a plurality of spaced and inwardly projecting resilient contact fingers integral with said body portion, a spacer for each of said grommet means which includes a flattened head portion engaging one of said side walls and having a neck portion extending through the opening in the associated grommet means for physically engaging the tips of said contact fingers, the neck portion of one of said spacers being of thin wall material to define an elongated adjustment slot, the neck portion of the other of said spacers being of thick wall material having an outer surface of substantially the same configuration as said one of said spacers and defining a locator opening therethrough, separate fastener means extending through said adjustment slot of said one of said neck portions through said locator opening of said neck portion of said other of spacers into engagement with said support and having washer means thereon for compressively loading said first and second grommet means so that said grommet means has a high spring rate in a longitudinal direction while said fingers of said grommet means deflect with a degree of resilience to provide a low spring rate in a radial direction and transverse to said longitudinal direction.

2. The combination of claim 1 wherein said fingers of said grommet means extend longitudinally between said side walls thereof and encompass said neck portions of said spacers.

* * * * *